US006688226B2

(12) United States Patent
Rossini et al.

(10) Patent No.: US 6,688,226 B2
(45) Date of Patent: Feb. 10, 2004

(54) SLEEVE FOR BLANKET CYLINDER OF AN INDIRECT OR OFFSET PRINTING MACHINE AND METHOD OF MAKING SAID SLEEVE

(75) Inventors: Felice Rossini, Milan (IT); Francesco Castelli, Verona (IT)

(73) Assignee: Erminio Rossini, S.p.A., Milan (IT)

( * ) Notice: Subject to any disclaimer, the term of this patent is extended or adjusted under 35 U.S.C. 154(b) by 103 days.

(21) Appl. No.: 09/971,108

(22) Filed: Oct. 3, 2001

(65) Prior Publication Data

US 2002/0038609 A1 Apr. 4, 2002

(30) Foreign Application Priority Data

Oct. 3, 2000 (IT) ..... MI2000A2138

(51) Int. Cl.[7] ..... B41F 13/10

(52) U.S. Cl. ..... 101/375; 101/401.1; 101/217; 492/48

(58) Field of Search ..... 101/375, 376, 101/217, 401.1, 492; 492/48

(56) References Cited

U.S. PATENT DOCUMENTS

| | | | | |
|---|---|---|---|---|
| 500,128 A | | 6/1893 | Heald | |
| 2,797,201 A | | 6/1957 | Veatch et al. | |
| 2,871,218 A | * | 1/1959 | Schollenberger | 525/440 |

FOREIGN PATENT DOCUMENTS

| | | |
|---|---|---|
| DE | 1165046 | 3/1964 |
| FR | 2061062 | 6/1971 |
| GB | 1099676 | 1/1968 |
| GB | 1307230 | 2/1973 |
| GB | 1327758 | 8/1973 |
| GB | 1354892 | 5/1974 |
| GB | 1400932 | 7/1975 |
| GB | 2089288 | 6/1982 |
| WO | WO 9309941 | 5/1993 |
| WO | WO 9318913 | 9/1993 |
| WO | WO 9700169 | 1/1997 |

OTHER PUBLICATIONS

EPO Search Report, Application No. 01118409.0–2304–, Jan. 24, 2002.

(List continued on next page.)

*Primary Examiner*—Eugene H. Eickholt
(74) *Attorney, Agent, or Firm*—Dority & Manning, P.A.

(57) ABSTRACT

A sleeve to be drawn over a rotary support in order to define a blanket cylinder of an indirect or offset printing machine, this cylinder cooperating with a lithographic plate cylinder from which it receives the date to be printed and with a substrate onto which said data are transferred, said substrate moving between the blanket cylinder and a pressure cylinder, the sleeve comprising an inner cylindrical portion to be drawn over the aforesaid rotary support and having its surface covered by a layered structure comprising at least one compressible layer and an incompressible outer layer arranged to cooperate directly with the lithographic plate and with the substrate to be printed; the layered structure being composed at least partly of polyurethane material.

20 Claims, 2 Drawing Sheets

U.S. PATENT DOCUMENTS 3,033,709 A 5/1962 Brown
3,147,698 A 9/1964 Ross
3,219,600 A 11/1965 Rucker
3,418,864 A 12/1968 Ross
3,479,811 A 11/1969 Walters
3,486,968 A 12/1969 Mater
3,616,145 A 10/1971 Clifton
3,616,178 A * 10/1971 Gurin ..... 101/401.1
3,673,023 A 6/1972 Ross
3,700,541 A 10/1972 Shrimpton et al.
3,795,568 A 3/1974 Rhodarmer et al.
3,887,750 A 6/1975 Duckett et al.
3,983,287 A 9/1976 Goossen et al.
4,015,046 A 3/1977 Pinkston et al.
4,025,685 A 5/1977 Haren et al.
4,042,743 A 8/1977 Larson et al.
4,086,386 A 4/1978 Gaworowski et al.
4,093,487 A 6/1978 Gaworowski et al.
4,093,764 A 6/1978 Duckett et al.
4,174,244 A * 11/1979 Thomas et al. ..... 442/224
4,303,721 A 12/1981 Rodriguez
4,422,895 A 12/1983 Shimura et al.
4,471,011 A 9/1984 Sporing
4,548,858 A 10/1985 Meadows
4,700,541 A 10/1987 Gabriel et al.
4,751,127 A 6/1988 Pinkston et al.
4,770,928 A 9/1988 Gaworowski et al.
4,812,357 A 3/1989 O'Rell et al.
4,981,750 A 1/1991 Murphy et al.
5,001,208 A 3/1991 Ross et al.
5,006,400 A 4/1991 Pinkston et al.
5,013,811 A 5/1991 Ross
5,215,013 A 6/1993 Vrotacoe et al.
5,245,923 A 9/1993 Vrotacoe
5,304,267 A 4/1994 Vrotacoe et al.
5,316,798 A * 5/1994 Tittgemeyer ..... 492/48
5,323,702 A 6/1994 Vrotacoe et al.
5,429,048 A 7/1995 Gaffney et al.
5,440,981 A 8/1995 Vrotacoe et al.
5,486,402 A * 1/1996 Flint et al. ..... 428/141
5,522,315 A 6/1996 Behnke et al.
5,553,541 A 9/1996 Vrotacoe et al.
5,644,985 A 7/1997 Serain et al.
5,648,447 A 7/1997 Seneker et al.
5,749,298 A 5/1998 Castelli et al.
5,754,931 A 5/1998 Castelli et al.
5,768,990 A 6/1998 Vrotacoe et al.
5,798,019 A * 8/1998 Cushner et al. ..... 156/425
5,863,367 A 1/1999 Behnke et al.
5,934,192 A * 8/1999 Ogita et al. ..... 101/376
5,974,973 A 11/1999 Tittgemeyer
5,974,974 A * 11/1999 Agnew et al. ..... 101/401.1
6,071,567 A 6/2000 Castelli et al.
6,182,568 B1 * 2/2001 Ogita et al. ..... 101/376
6,205,921 B1 * 3/2001 Dzierzynski et al. ..... 101/217
6,207,597 B1 * 3/2001 Ogita et al. ..... 442/194
6,308,624 B1 * 10/2001 Sugiya et al. ..... 101/401.1

* cited by examiner

SLEEVE FOR BLANKET CYLINDER OF AN INDIRECT OR OFFSET PRINTING MACHINE AND METHOD OF MAKING SAID SLEEVE

BACKGROUND OF THE INVENTION

The present invention relates to a sleeve for an indirect or offset printing machine and in particular to an offset blanket cylinder.

As is well known, an offset machine or a lithographic rotary machine with indirect printing mainly comprises three cylinders. A first cylinder carries lithographic plates and is in contact with inking rollers and wetting rollers. A second, subsidiary cylinder (or blanket cylinder) receives the inked data to be printed (i.e., "the impression") from the first cylinder. These data are transferred to a substrate or web of paper or other material (for example plastic), interposed between the blanket cylinder and a third cylinder or pressing (or printing) cylinder. After transforming the inked data to the substrate, the surface of the blanket cylinder passes through a bath of solvents that wash the residual ink from the surface of the blanket cylinder.

The blanket cylinder is usually covered with a natural rubber blanket, which can have either a "compressible" structure, i.e., with a compressible layer, or a "conventional" structure, i.e., without a compressible layer. Various methods (and corresponding products) for producing the blanket cylinder are known. One of these uses a blanket of flat natural rubber with a yieldable (compressible) structure. The cylinder has an axial slot disposed parallel to the longitudinal axis. The rubber is wrapped about the blanket cylinder with its ends inserted into the slot and fixed to the cylinder by inserting a bar into the axial slot to retain the ends of the rubber therein.

The use of this type of blanket cylinder gives rise to various problems. For example, the presence of said slot results in mechanical imbalance of the cylinder structure. When the slot passes through the contact region between the respective cylinders, the pressure exerted between the blanket cylinder and the printing cylinder (or plate cylinder) varies. This cyclic pressure variation leads to vibration and stresses on the blanket cylinder and results in poor print quality on the substrate.

Said imbalance also limits the maximum rotational speed of the cylinder. Exceeding the maximum rotational speed generates stresses that can mechanically damage the printing machines. This limitation in rotational speed in turn limits the amount of printed substrate that can be produced in a given amount of time.

The presence of the slot also results in wastage of the substrate by creating a void in the print on the substrate.

This known method and resultant solution was later overtaken by other solutions. For example, offset presses began using a rotary support or mandrel that carries a cylindrical blanket sleeve, which together with the mandrel function as the blanket cylinder. This blanket sleeve includes an inner cylindrical portion or core that is formed as a hollow cylindrical body or sleeve. The core is typically formed of a thin-walled nickel tube that has a radial thickness in the range of seven thousandths of an inch thick to ten thousandths of an inch. The core is configured to be selectively drawn over the mandrel and locked to the mandrel. Thus, the blanket sleeve can be mounted on and dismounted from the mandrel, as by pressurized air for example, and therefore is independent from the rotary mandrel of the offset press. The blanket sleeve includes a compressible layer positioned on the inner cylindrical portion (core), a substantially incompressible reinforcement layer positioned on the compressible layer, and finally a printing layer that receives the inked data.

The compressible layer comprises a first continuous tubular body (without joints) of elastomeric material (natural rubber) presenting internally a plurality of cavities that determine the "compressibility" of the layer. To produce this compressible layer on the inner cylinder (core) first requires placing the natural rubber material into solution to form a liquid. This is accomplished by adding solvents to the solid natural rubber to provide the rubber in liquid solution. Then microspheres (that ultimately will produce the desired cavities in the compressible layer) are mixed into that rubber solution. Then, in a very time consuming process that requires considerable operator skill, the natural rubber solution with the microspheres is applied to the surface of the inner cylinder (core) by a knife coating technology or ring coating technology for example to build up a precursor layer of about one millimeter in radial thickness. However, because natural rubber does not adhere well to nickel surfaces, when the core is formed of nickel, an adhesive preparation must be provided. For example, a two-sided adhesive tape is typically first wound around the nickel core, and the rubber solution is applied to the exposed surface of the tape rather than to the bare nickel surface.

The use of a knife coating technology to produce this precursor layer requires an operator to mount the core onto a rotating mandrel. As the mandrel rotates, the operator must apply the liquid rubber solution with the microspheres to the surface of the rotating core. At the same time, a knife blade rises automatically to even out the surface being created while heated air is applied to remove the solvent from the solution as the core is rotating. The amount of solution being applied by the operator will vary depending on the consistency of the solution. If the solution is running it will not form the solid layer around the core. The consistency of the solution depends on the atmospheric ambient conditions of temperature, humidity and barometric pressure. These conditions also affect whether the solvent is removed completely during each revolution of the core on the mandrel. The solvent, which is volatile, must be completely removed prior to the next step, which is subjecting the precursor layer to heat that is sufficient (100 to 130 degrees centigrade) to cure the rubber. The generation of the precursor layer using the knife coating technology takes on the order of two to three hours for a typical sleeve or cylinder.

Once this preliminary thickness of the precursor layer has been attained, the natural rubber forming the precursor layer must be cured by the application of heat and pressure in another time-consuming process that requires operator manipulation of the cylinder. First, a tape that shrinks when subjected to curing temperatures (noted above) is wound around the precursor layer. The taped sleeve may be placed into an oven and maintained at curing temperatures (noted above) for two to three days. As the tape shrinks, the necessary pressure is applied to the precursor layer in order to effect curing of the natural rubber. Once the curing step is done, the cylinder must be manipulated to another station where the surface of the precursor layer can be ground down to the desired thickness (typically three tenths to seven tenths of a millimeter) of the compressible layer forming a tubular body.

Reinforcement structures such as threads or meshes (of cotton or other material) can be built on top of the compressible layer. The reinforcement layer can be defined by an elastomeric matrix containing threads, preferably of cotton. The threads can be continuous or discontinuous. These reinforcement structures can be applied spirally or linearly on the compressible layer. The function of this reinforcement layer is to form a support structure with physical and mechanical characteristics that are far superior to those of the elastomeric natural rubber matrix that forms the compressible layer and the outer printing layer (now to be described).

Finally, the surface printing layer is formed of elastomeric material (natural rubber) on top of the tubular body with the reinforced structure. The surface printing layer can be formed like the compressible layer, except without the use of microspheres and the voids created thereby. Alternatively, the surface printing layer can be formed by another technology such as by extrusion of a natural rubber sleeve onto and around the reinforcing layer. The final surface of the outer printing layer is continuous and without joints. All of the layers of the known sleeve are all bonded together to form a single body. However, the required operator involvement and manipulation steps in the production process required to fabricate the known blanket sleeve prevent significant automation of this fabrication process. The low level of automation adversely affects the consistency of the sleeve that can be produced.

The consistency of the compressible layer is important for printing quality, and end users of the blanket sleeves are specifying acceptable ranges for compressibility. Moreover, the compressibility must stay within the specified range over time. However, the consistency of the compressible layer obtainable in the known rubber blanket sleeves is limited by the high degree of operator involvement and judgment during the fabrication process as well as by the unpredictable ambient conditions under which different sleeves are made for the same end-user. Moreover, residual solvent in the compressible layer will continue to create voids in the compressible layer and thus changes the compressibility of the overall sleeve over time. Residual solvent is a consequence of the fabrication process of the known rubber blanket sleeves. Thus, while a known rubber blanket sleeve may be delivered to the end-user with an acceptable compressibility, the compressibility of that sleeve may change enough over time to become outside the acceptable range.

Moreover, the aforesaid known blanket cylinder presents an outer layer of natural rubber or elastomeric material with inferior physical and mechanical characteristics, equivalent to those of rubber. The outer layer has poor mechanical strength, at least partly because of these characteristics of natural rubber. Consequently, the outer layer undergoes considerable wear during use. This wear is caused by the action on this outer layer of the blanket sleeve by the metal plate of the plate cylinder or by the edges of the substrate being printed, or by poor resistance to the wash solvents used in the printing process. A fold or other thickness variation in the substrate can irreversibly damage the surface of the outer layer and render the entire cylinder useless. Moreover, the recurring pressure applied to the printing surface during repeated printing on the press eventually overcomes the outer layer's reboundability, i.e., its ability to resist permanent compression. Once the original thickness of this outer printing layer is diminished, the blanket sleeve becomes incapable of transferring the inked data to the substrate with the desired resolution of the printed image. This is particularly a problem in presses that print on both sides of the substrate and thus have a blanket cylinder on each side of the substrate, thus potentially doubling the problem as a bad image on one side of the substrate renders the entire substrate useless. Additionally, when the sleeve has a thin nickel core, the sleeve can become irreversibly damaged because the thin nickel core tends to kink during mounting and dismounting of the sleeve onto the rotary mandrel of the offset printing machine. These factors combine to curtail the "useful life" or duration of a blanket sleeve of the aforesaid known type. This curtailment presents obvious drawbacks from an economical viewpoint, especially in the cost of employing an offset printing machine that requires a plurality of blanket cylinders.

OBJECTS AND BRIEF SUMMARY OF THE INVENTION

An object of the present invention is therefore to provide a blanket cylinder and/or blanket sleeve having superior physical and mechanical characteristics than known cylinders and/or sleeves such as to offer higher wear resistance, better reboundability, and greater resistance to creases in the surface and hence prolong the useful life of the product, said blanket sleeve being able to be removably coupled to the rotary member or support (mandrel) of the offset printing machine to form a portion of said blanket cylinder.

A further object is to provide a blanket sleeve of the stated type having a lower cost than known sleeves for known blanket cylinders.

A still further object of the invention is to provide a method whereby a blanket sleeve of the stated type can be produced in a shorter time than conventional sleeves.

A yet further object of the invention is to provide a method whereby a consistent blanket sleeve of the stated type can be produced regardless of ambient conditions and personnel available during production.

Another object of the invention is to provide a method whereby a blanket sleeve of the stated type can be produced by procedures that are more automated than the procedures for making conventional sleeves.

Additional objects and advantages of the invention will be set forth in part in the description that follows, and in part will be obvious from the description, or may be learned by practice of the invention. The objects and advantages of the invention may be realized and attained by means of the instrumentalities and combinations particularly pointed out in the appended claims. To achieve the objects and in accordance with the purpose of the invention, as embodied and broadly described herein, a blanket cylinder and method for making same now will be described in summary fashion.

A blanket cylinder is provided that employs polyurethane material for the compressible layer instead of the natural rubber found in conventional blanket sleeves. The compressible layer of the improved blanket sleeve can be provided with a density in the range of between about 0.2 $g/cm^3$ and 0.9 $g/cm^3$ and desirably between about 0.5 $g/cm^3$ and 0.9 $g/cm^3$. Polyurethane also may be used to form the incompressible blanket layer instead of the natural rubber found in conventional blanket sleeves. The incompressible blanket layer of the improved blanket sleeve can be provided with a density in the range of between about 1.0 $g/cm^3$ and 1.6 $g/cm^3$. In some embodiments, a reinforcing layer may be interposed between the compressible layer and the incompressible blanket layer.

To further achieve the objects and in accordance with the purpose of the invention, as embodied and broadly described herein, the improved method of making the improved blanket sleeve includes providing a cylindrical body to define the inner cylindrical portion of the blanket sleeve and forming at least one blanket layer including polyurethane material carried by the cylindrical body and defining a printing surface for receiving the inked data to be transferred to the substrate. The method also desirably includes providing the cylindrical body composed of nickel, or a metal wire mesh or resin embedded with fiber such as fiberglass, carbon fiber, or aramid fiber.

The method desirably includes forming a compressible layer between the blanket layer and the inner cylindrical portion by depositing a first pasty polyurethane material on the outer surface of the inner cylindrical portion and causing the first pasty polyurethane material to solidify on the outer surface of the inner cylindrical portion to define the compressible layer of the sleeve. The first pasty polyurethane material is preferably elastomeric such as a polyether polyurethane or polyester polyurethane. The first pasty polyurethane material can be obtained by mixing a polyol and microspheres having a shell of a phenolic type of thermosetting resin surrounding a gas like isobutane or by mixing a polyol and swelling agents that release gas when heated or by mixing a polyol and water-soluble salts such as sodium chloride, magnesium chloride or magnesium sulphate. Ribbon technology is desirably used for depositing the first pasty polyurethane material on the outer surface of the inner cylindrical portion. Causing the first pasty polyurethane material to solidify on the outer surface of the inner cylindrical portion is desirably accomplished by cross-linking the first polyurethane material at ambient pressure. This cross-linking can be allowed to proceed for about five hours if carried out at ambient temperature or can be accelerated by the addition of heat and/or cross-linking agents. The compressible layer can be ground to the desired thickness and uniform surface.

The method desirably includes forming the incompressible blanket layer on the compressible layer. The incompressible blanket layer can be formed of a second pasty polyurethane material that is preferably elastomeric such as a polyether polyurethane or polyester polyurethane. Alternatively, the method includes forming the incompressible blanket layer on a reinforcing layer that is formed around the compressible layer. The reinforcing layer can be formed in any conventional way. In each case, the blanket layer desirably can be formed by ribbon technology or by extrusion technology for example. If formed by ribbon technology, cross-linking can occur at ambient pressure. Cross-linking also can occur at ambient temperature or can be accelerated by the addition of heat and/or cross-linking agents. The incompressible blanket layer can be ground to the desired thickness and uniform surface.

BRIEF DESCRIPTION OF THE DRAWINGS

The invention will be more apparent from the accompanying drawings, which is provided by way of non-limiting example and in which.

DETAILED DESCRIPTION OF THE PREFERRED EMBODIMENTS

With reference to said Figs., a blanket cylinder of an offset printing machine is indicated overall by the numeral 1 and comprises a rotary support or mandrel 2 over which a layered sleeve 3 is drawn. The mandrel/sleeve system can be either of two types. In one type, the inner diameter of the sleeve remains fixed, and the outer diameter of the mandrel expands and contracts (usually with the aid of an hydraulic system) to permit mounting and dismounting of the sleeve to the mandrel. In another type, the outer diameter of the mandrel remains fixed, and the inner diameter of the sleeve expands and contracts (usually with the aid of a compressed air system) to permit mounting and dismounting of the sleeve to the mandrel.

The mandrel 2 is of known type provided with internal ducts (not shown) opening at 4 onto a free surface 2A of the mandrel at one end 2B of the mandrel. These ducts carry onto the surface 2A compressed air fed by a pipe 5 connected to the mandrel. By virtue of this air and a small outward radial deformation of the inner hollow surface of the sleeve 3, said sleeve is able to be drawn over the mandrel 2.

Figure 1:
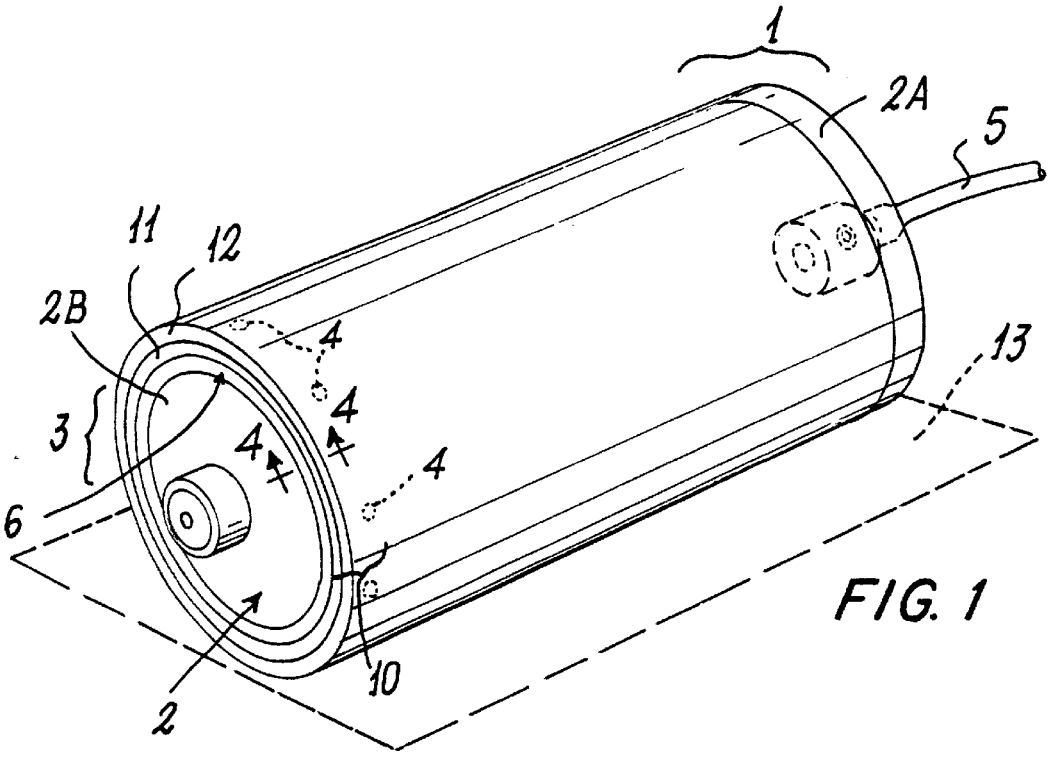
FIG. 1 is a perspective view of a blanket cylinder presenting a presently preferred embodiment of a sleeve obtained in accordance with the invention, mounted on an independent rotary mandrel.
Figure 2:
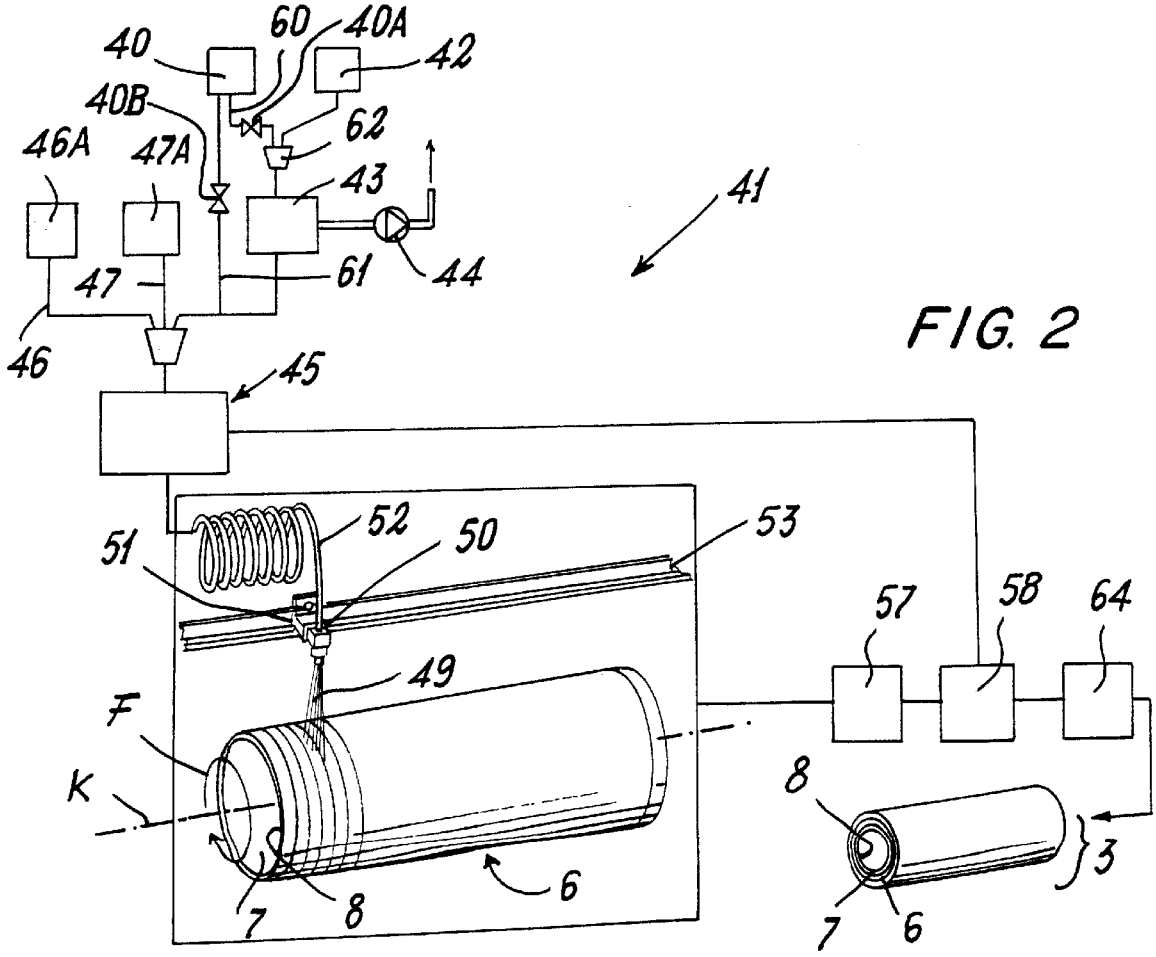
FIG. 2 shows a block diagram of a presently preferred embodiment of a method for obtaining a sleeve in accordance with the invention.

As shown in FIG. 1, the sleeve 3 comprises an inner tubular cylindrical portion 6 arranged to cooperate directly with the surface 2A of the mandrel 2. In particular, as shown in FIG. 2 for example, the cylindrical portion 6 has a through longitudinal bore 7 enabling the sleeve to be mounted on the mandrel and presents an inner surface 8 arranged to cooperate with the mandrel's outer surface 2A (FIG. 1).

On the cylindrical portion 6 there is positioned a layered structure 10 (see FIG. 4 in particular) comprising at least one compressible layer 11 and an incompressible outer layer 12. As shown in FIG. 1, the outer surface of layer 12 is arranged to cooperate directly with a lithographic plate (not shown) carried by another cylinder (not shown) of the printing machine, and with a substrate 13 (for example a web of paper or plastic) on which the printing is to take place.

More particularly, when intended for mounting on a rotary mandrel of fixed diameter, the cylindrical portion 6 is constructed of material sufficiently elastic to enable the portion itself to elastically expand radially by a minimum amount to enable it to be mounted on the mandrel 2. In this case, the portion 6 is preferably constructed of a thin nickel shell or can have a composite structure of resins and fiber glass with a radial thickness of about 0.05 cm. Examples of compositions that are suitable for composing the portion 6 include one of the group consisting of aramid fiber bonded with epoxy resin or polyester resin, and reinforced polymeric material such as hardened glass fiber bonded with epoxy resin or polyester resin, the latter two also known as fiberglass reinforced epoxy resin or fiberglass reinforced polyester.

Alternatively, when intended for mounting on a rotary mandrel of changeable diameter, the cylindrical portion 6 is constructed of material sufficiently inelastic to enable the portion 6 to retain a fixed diameter under pressure from the expanding mandrel. In this case, the portion 6 is desirably constructed of a composite structure of graphite impregnated plastics or of resins and fibers such as carbon fibers. In the latter, the carbon fiber is desirably oriented parallel to the rotational axis K (FIG. 2) in order to provide portion 6 with maximum rigidity. The portion 6 can also be constructed of a strip of metal or rigid polyurethane with a hardness exceeding 70° Shore D.

The elasticity of the portion 6 can be related to the radial thickness of the portion 6, which can have a radial thickness between 0.01 cm and 0.08 cm when intended to be expandable and depending on the material used for its construction. In embodiments requiring the portion 6 to expand in order to be mounted on the rotary mandrel, the material forming the portion 6 cannot be so thick that it is rendered unable to expand sufficiently to be mounted on the mandrel when the compressed air is applied to the elastic portion 6 through the openings 4.

Figure 4:
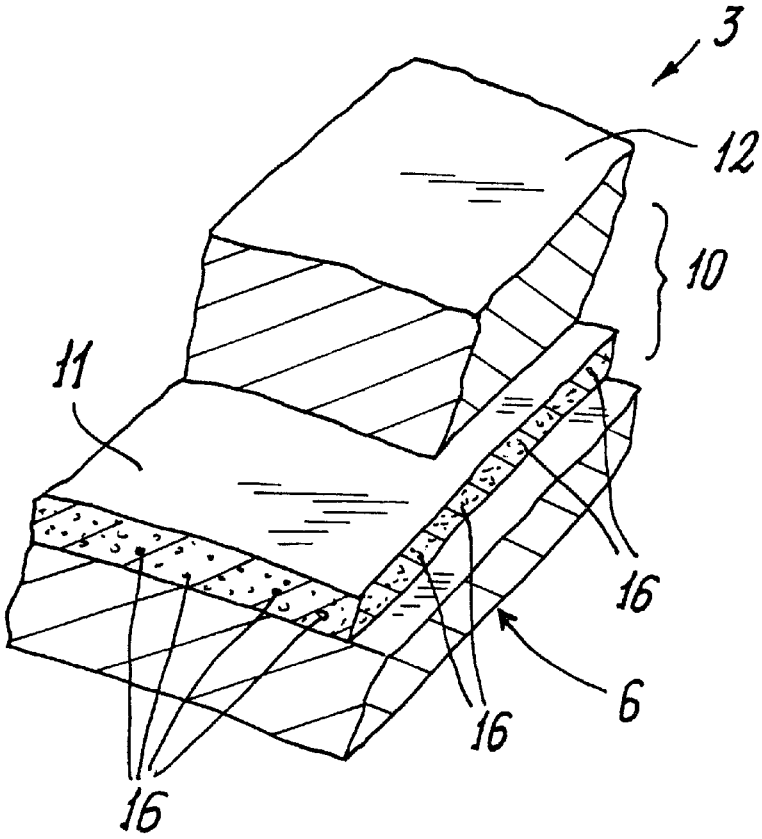
FIG. 4 is a partial cross-sectional view on the line 3—3 of FIG. 1.

According to the presently preferred embodiments of the invention and as shown in FIG. 4 for example, the layered structure 10 carried by the inner cylindrical portion 6 is formed of polyurethane material, preferably elastomeric, based on polyether or polyester.

More particularly, the compressible layer 11 desirably has a density of between 0.2 g/cm$^3$ and 0.9 g/cm$^3$. It is formed desirably with open cells or closed cells. Preferably, the density of the compressible layer 11 is between about 0.4 g/cm$^3$ and 0.9 g/cm$^3$.

As shown in FIG. 4 for example, the compressible layer 11 is preferably formed of polyurethane of cellular structure with internal cells or voids 16. These cells 16 desirably can be obtained by inserting into the polyurethane material a plurality of compressible microspheres, which thus become encapsulated within the compressible layer 11 when it sets. These microspheres comprise, for example, a shell mainly consisting of a copolymer of vinylidene chloride, acrylonitrile and/or methacrylate, or other similar thermoplastic resins. As used herein, a copolymer includes repeating units composed of two or more monomers. The shell can also be obtained from a thermosetting resin (e.g., of phenolic type). These microspheres desirably contain gaseous isobutane.

Alternatively, the aforesaid cells 16 are obtained by mixing the polyurethane with swelling agents followed by expansion. These agents are known per se (such as that known commercially as POROFOR available from Bayer, the well known manufacturer of chemicals headquartered in Germany) and develop nitrogen or other gases when heated. The developed gas expands to create said voids 16 within the compressible layer 11.

In a further variant, the cells or voids 16 are obtained by mixing the polyurethane material with water-soluble salts such as sodium chloride or magnesium chloride or magnesium sulphate. The particles of these salts dispersed homogeneously within the polyurethane material are then removed by water, to generate a so-called "open cell" structure.

As shown in FIG. 4 for example, the surface printing layer 12 is also composed of polyurethane. In contrast to the compressible layer 11, the incompressible layer 12 has a desired density of between 1 g/cm$^3$ and 1.6 g/cm$^3$. This density of the incompressible layer 12 is preferably between 1 g/cm$^3$ and 1.3 g/cm$^3$. The surface layer (printing surface) 12 has a hardness of between 40° and 75° Shore A, has good resistance to wash solvents, and has an ultimate elongation of between 300% and 1000%.

Figure 3:
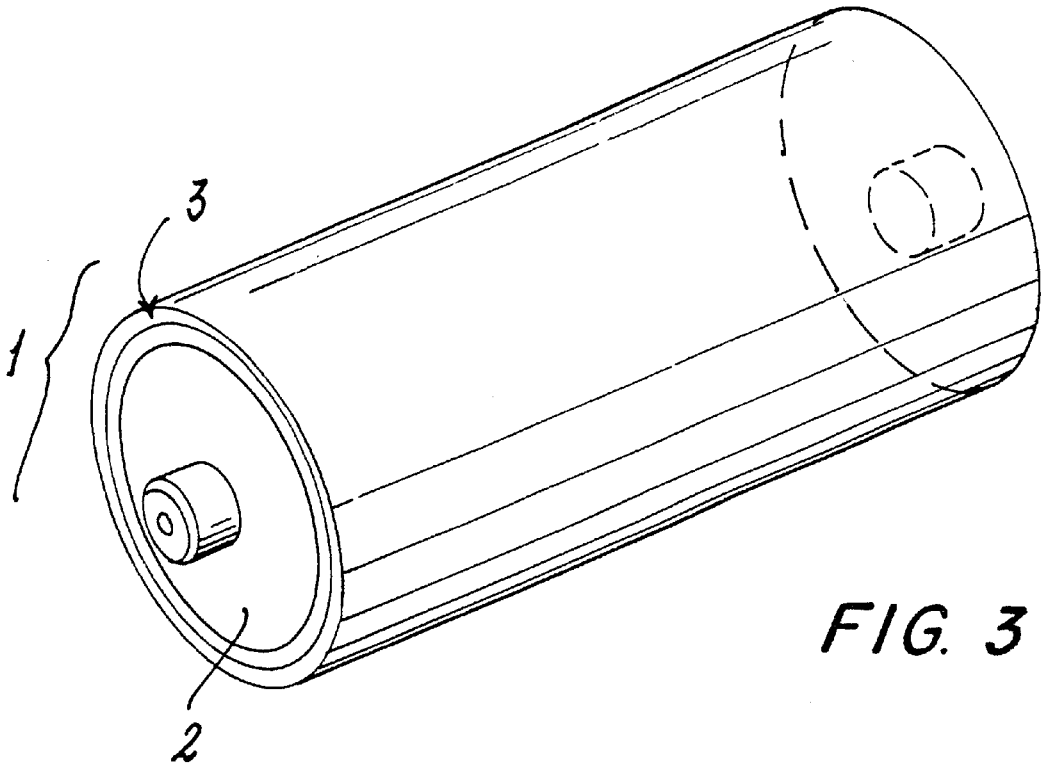
FIG. 3 is a perspective view of an alternative embodiment of the invention showing a blanket cylinder presenting a rotary portion clad directly with a sleeve that is integral with the rotary portion.

The aforesaid blanket sleeve 3 is independent of the mandrel 2. Sleeve 3 can be easily transported (by virtue of its lightness) and can be drawn over the mandrel to form the cylinder 1. As shown in FIG. 3 for example, the blanket sleeve 3 can obviously be formed as an integral part of the cylinder 1 when sleeve 3 becomes stably locked to the mandrel 2. In this case, the inner cylindrical portion 6 described in relation to FIG. 1 mates with the mandrel 2. Alternatively, the layered structure 10 shown in FIG. 4 can be formed directly on and thus carried by the mandrel 2 to form the blanket cylinder 1 shown in FIG. 3 for example. In this latter case, the outer surface of the mandrel 2 takes the place of the outer surface of the inner cylindrical portion 6.

The production of an embodiment of blanket sleeve 3 of the type that can be drawn over a rotary mandrel, will now be described with reference to FIG. 2.

In producing the blanket sleeve 3, a cylindrical body is provided to define the inner cylindrical portion 6 of the blanket sleeve. The inner cylindrical portion 6 is obtained by methods that are known per se and therefore not described. Moreover, the production of the inner cylindrical portion 6 can be at least largely automatic.

Simultaneously with (or previously) the fabrication of the inner cylindrical portion 6, the polyol used for preparing the polyurethane material to obtain the layer 11 is fed into a first tank 40 of a plant 41. Some examples of suitable polyols can be found in U.S. Pat. No. 5,648,447, which is hereby incorporated herein by this reference. First tank 40 is connected to a mixer 62 via a line 60. A valve 40A in line 60 can be opened or closed to control whether any flow occurs through line 60 from first tank 40 to mixer 62. A line 61 also leads from first tank 40 and has a valve 40B that can be opened or closed to control whether any flow occurs through line 61 from first tank 40. A suitable quantity of microspheres is fed into a second tank 42, which is also connected by another line to mixer 62. Yet another line connects mixer 62 to a mixing chamber 43, which can be placed under vacuum by a vacuum pump 44. The operation of the mixer 62, the valves 40A, 40B and pump 44 can be controlled automatically and remotely as by computerized process controls for example.

In one embodiment of the process, valve 40B is closed and valve 40A is opened. The polyol product contained in first tank 40 and the microspheres contained in second tank 42 are fed into mixer 62. The mixed product of polyol and microshperes leaving mixer 62 is drawn into mixing chamber 43 by vacuum pump 44. The quantity of microspheres fed into mixing chamber 43 is generally between 1% and 6% of the polyol by weight and more desirably between about 1% and 3% of the polyol by weight and yet more desirably about 2% of the polyol by weight.

Alternatively, valve 40A is closed and valve 40B is opened. The microspheres can be mixed with the polyol outside of the production cycle. In this alternative case, the base solution in first tank 40 comprises polyol already mixed with microspheres.

A mixing member 45 (or simply mixer) is basically a small chamber having a rotor for mixing and is provided with two basic components. One of the components is the polyol (either mixed with microspheres or not, as the case may be), which is a viscous product, nearly in paste form, that leaves the chamber 43 (or first tank 40 in the alternative embodiment) and is fed into mixing member 45. This first component also can include other ingredients, as desired, such as pigments, fillers, diamines, and catalysts. The second component is primarily a cross-linking element (such as isocyanate), and a thixotropic cross-linking agent (such as an amine) also can be included as part of the second component. As shown schematically in FIG. 2, line 46 feeds into mixer 45 from tank 46A containing a cross-linking element. Diphenyl methane-4-4-diisocyanate (also known as MDI) is a suitable cross-linking element. Similarly, line 47 feeds into mixer 45 from tank 47A containing a thixotropic cross-linking agent such as an amine.

The first component is the main component by weight provided to mixer 45. The ratio by weight of the first component (polyol mixed with microspheres) to the second component (combination of the cross-linking element and the cross-linking agent) is desirably in the range of about 70% to 30% to about 65% to 35%. For producing the compressible layer 11, the weight ratio is desirably in the range of about 100:38 to 100:40. The blanket sleeve's desired characteristics of hardness, resilience, reboundability, solvent resistance, and mechanical characteristics can be tailored by changing the chemical structure of the two components.

Note that the two components combine in the mixer 45 to form a pasty product. As shown schematically in FIG. 2, the pasty product 49 leaves the mixer 45 via a line 52 to be deposited on the outer surface of the cylindrical portion 6 according to ribbon technology. During deposition, cylindrical portion 6 is rotated about its axis K as shown by the arrow F in FIG. 2. Desirably, the pasty product is provided from nozzle 50 in the form of a continuous ribbon 49 as opposed to a spray that contains discontinuous droplets entrained in a gas. As shown schematically in FIG. 2, the pasty product 49 can be fed via line 52 to a nozzle 50 that is configured to deposit a continuous ribbon of the pasty product 49 directly onto the outer surface of the cylindrical portion 6. The pasty product 49 undergoes an exothermic chemical reaction and forms the cross-linked polyurethane layer 11 that adheres to the surface of the cylindrical portion without the aid of adhesives, regardless of whether the cylindrical portion is formed of a nickel shell or a core formed of a fiber embedded resin.

The nozzle 50 and cylinder 6 are movable with respect to each other in traversing axial movements. The nozzle 50 can be associated with a carriage 51 (to which a hose 52 is connected from the mixer 45) that is movable along a straight guide 53 arranged parallel to the axis K of the cylindrical portion 6.

The pasty product 49 leaving the mixer 45 is deposited in one or more passes on the surface of the portion 6. On termination of deposition, the material deposited on the cylindrical portion 6 is cross-linked to develop the desired physical and mechanical characteristics of the compressible layer 11 structure. At ambient pressure and temperature, at least five hours would typically allow a suitable time period to enable cross-linking to take place to produce the desired three-dimensional structure with voids 16. For example, the heat released during cross-linking causes the gas trapped in the microspheres to expand and create the voids 16, which remain after the heat dissipates and the microspheres contract.

When this time period for cross-linking has passed, the surface of the compressible surface layer 11 superposed on portion 6 in this manner is ground to the desired finish. This grinding step carried out on the layer 11 is indicated schematically by the block 57 of FIG. 2. The purpose of this grinding is to obtain a desired radial thickness of compressible layer 11. However, before doing so, a quality control check is performed on the compressibility of the compressible layer 11. For the desired radial thickness can vary depending on the type of use intended for the blanket cylinder under production, i.e., on such factors as the deformation that the compressible layer 11 must undergo during its life, on the ink to be used with the cylinder, etc. In a typical embodiment, this desired radial thickness is between about 0.2 mm and 1.0 mm and is preferably between about 0.3 mm to 0.4 mm.

After the compressible layer 11 has been ground, this layer 11 can be covered with the surface printing layer 12. The operation for forming the surface printing layer 12 is indicated schematically in FIG. 2 by the block 58 and the line connecting mixer 45 with block 58. The formation of the surface printing layer 12 can be obtained in a manner similar to that indicated hereinbefore for depositing the compressible layer 11 on the portion 6 using ribbon technology. However, the mixer 45 receives only the polyol from the first tank 40, but no microspheres. Valve 40B is opened, and valve 40A is closed. The cross-linking agents from tanks 46A and 47A are mixed with the polyol leaving first tank 40, and provided in the mixer 45. The ribbon of pasty product 49 leaving the mixer 45 is deposited on the already formed compressible layer 11 by the same nozzle 50 (previously cleaned) or by another nozzle equivalent to this latter (and movable with it).

After the time required (at least five hours) for the product deposited on the layer 11 to set and the surface printing layer 12 to form at ambient temperature and pressure, then the outer surface of layer 12 is ground and polished. The block 64 of FIG. 2 schematically indicates the polishing step to thus obtain the final product in the form of sleeve 3.

In some embodiments it may be advantageous for a "resistant structure," cotton threads (or other material) for example, to be inserted into the product as a reinforcing layer. When included at all, such a reinforcing layer (not shown) is advantageously positioned at the interface between the compressible layer 11 and the incompressible layer 12. Thus, the reinforcing layer would be constructed on the compressible layer 11 and before the construction of the surface printing layer 12, which desirably would be formed on the reinforcing layer. The construction and insertion of a reinforcing layer can be achieved in any known manner, and examples are to be found in U.S. Pat. Nos. 5,304,267 and 5,323,702, which are hereby incorporated herein in their entireties by this reference.

Desirably, the reinforcing layer can be formed as a hard layer of urethane material without any supplementary textile reinforcement. This hard layer of urethane material is desirably obtained for any given mixing of polyol and isocyanate by varying the ratio of polyol to isocyanate. The ratio of polyol to isocyanate can be chosen in order to stabilize the overall blanket sleeve structure and to avoid microslip phenomena in the nip area. This allows the resulting hard layer of urethane to be used as a reinforcing layer that is disposed in between the compressible layer and the top layer. The hard layer functions as a shape-retaining element for stabilizing the compressible layer.

At least two approaches can be taken for the urethane-based hard layer. In the first approach, the hard layer is formed with a hardness of about 80° Shore D and a density in the range of about 1.5 g/cm$^3$ to 1.6 g/cm$^3$. The ratio of parts by weight of the first component (primarily polyol) to the second component (primarily isocyanate) is about 100 to 30. This first approach makes for a very hard resistant layer that creates a stress-resistant barrier in order to substantially avoid (if not eliminate altogether in any detectable degree) any compressible layer distortion.

In the second approach, the hard layer is formed with a hardness of about Shore A 75° and a density in the range of about 1.2 g/cm$^3$ to 1.3 g/cm$^3$. The ratio of parts by weight of the first component (primarily polyol) to the second component (primarily isocyanate) is again about 100 to 30, but the second component includes more fillers. This second approach also may entail choosing a different isocyanate than in the first approach in order to result in a relatively softer hard layer than in the first approach. Thus, the hard layer produced in this second approach is somewhat rubbery with the elongation in the range of about 500% to 600%. Conceptually, the second approach can be thought of as producing a hard layer that is part of the printing layer 12 such that the printing layer 12 could be considered to be composed of a relatively soft upper portion for carrying ink to the substrate and a relatively hard lower portion that is supportive of the upper portion and resistant to transmission of stresses to the compressible layer 11.

Other variants of embodiments of the invention can be defined in the light of the present text. For example, instead of forming the polyurethane layers 11, 12 on the surface of cylindrical portion 6 to form a blanket sleeve 3, these polyurethane layers 11, 12 may just as easily be formed on the outer surface of a cylinder 2 and thus yield a blanket cylinder 1 as shown in FIG. 3. Additionally, the amount of time devoted to cross-linking following formation of the layers 11 and 12 can be reduced by placing the obtained product into an oven at a temperature not exceeding 120° C., or by accelerating the cross-linking reaction by subjecting the product to irradiation. By each of these means, the aforesaid cross-linking time of five hours can be substantially reduced.

The aforesaid method can be implemented automatically or largely automatically. However, it may be economically more desirable to effect the manual manipulation of the sleeve rather than machine handling of the sleeve, for surface grinding of the layers 11 and 12.

A sleeve and/or cylinder with a layered structure of polyurethane material has been described together with methods for making same. However, these structures can also be composed only partially of this polyurethane material, in which case one of the layers 11 and 12 (for example the layer 11) is elastomeric natural rubber and the other layer (the layer 12) is of polyurethane material (or vice versa).

What is claimed is:

1. A blanket sleeve, to be drawn over a rotary support in order to define a blanket cylinder of an indirect or offset printing machine, this blanket cylinder to cooperate with a lithographic plate cylinder from which the blanket cylinder receives the inked data to be printed and with a substrate onto which said inked data are transferred, said substrate moving between the blanket cylinder and a pressure cylinder, the blanket sleeve comprising:

an inner cylindrical portion configured to be drawn over the rotary support and defining an outer surface;

a compressible layer formed on said outer surface of said inner cylindrical portion, said compressible layer being formed at least partly of polyurethane material;

an incompressible outer layer carried by said compressible layer and defining an outer surface configured to cooperate with the lithographic plate and with the substrate to be printed; and wherein said incompressible layer has a density of between about 1 g/cm$^3$ and 1.6 g/cm$^3$.

2. A sleeve as in claim 1, wherein said incompressible layer has a hardness of between about 40° and 70° Shore A.

3. A sleeve as in claim 1, wherein said incompressible layer has a density of between about 1 g/cm$^3$ and 1.3 g/cm$^3$.

4. A sleeve as in claim 3, wherein said incompressible layer has an ultimate elongation of between 300% and 1200%.

5. A blanket sleeve, to be drawn over a rotary support in order to define a blanket cylinder of an indirect or offset printing machine, this blanket cylinder to cooperate with a lithographic plate cylinder from which the blanket cylinder receives the inked data to be printed and with a substrate onto which said inked data are transferred, said substrate moving between the blanket cylinder and a pressure cylinder, the blanket sleeve comprising:

an inner cylindrical portion configured to be drawn over the rotary support and defining an outer surface;

a compressible layer formed on said outer surface of said inner cylindrical portion, said compressible layer being formed at least partly of polyurethane material;

an incompressible outer layer carried by said compressible layer and defining an outer surface configured to cooperate with the lithographic plate and with the substrate to be printed; and wherein said inner cylindrical portion is formed of metal obtained from metal wire.

6. A method for making a blanket sleeve for the blanket cylinder of an offset printing machine that operates on a substrate, the method comprising the following steps:

a) providing a cylindrical body to define the inner cylindrical portion of the blanket sleeve; and b) forming at least one blanket layer including polyurethane material carried by said cylindrical body and defining a printing surface for receiving the inked data to be transferred to the substrate;

wherein a compressible layer is provided between said blanket layer and said inner cylindrical portion by the steps comprising:

a) depositing on the outer surface of said inner cylindrical portion a first pasty polyurethane material; and b) causing said first pasty polyurethane material to solidify on the outer surface of said inner cylindrical portion to define the compressible layer of the sleeve; and wherein said step of deposition of said first polyurethane material on the cylindrical portion to form the compressible layer is carried out using ribbon technology.

7. A method as in claim 6, wherein deposition of said first polyurethane material on said cylindrical portion and deposition of said second polyurethane material on said compressible layer are carried out by moving relative to each other said cylindrical portion and at least one nozzle from which said respective first and second polyurethane material emerges, said movement taking place parallel to a longitudinal axis of said cylindrical portion.

8. A method for making a blanket sleeve for the blanket cylinder of an offset printing machine that operates on a substrate, the method comprising the following steps:

a) providing a cylindrical body to define the inner cylindrical portion of the blanket sleeve;

b) forming at least one blanket layer including polyurethane material carried by said cylindrical body and defining a printing surface for receiving the inked data to be transferred to the substrate;

c) providing a compressible layer between said blanket layer and said inner cylindrical portion by the steps comprising:

i) depositing on the outer surface of said inner cylindrical portion a first pasty polyurethane material; and ii) causing said first pasty polyurethane material to solidify on the outer surface of said inner cylindrical portion to define the compressible layer of the sleeve; and wherein after said deposition of said first polyurethane material, cross-linking said first polyurethane material at ambient temperature and pressure for a period of time of at least five hours for consolidation of said first polyurethane material.

9. A method for making a blanket sleeve for the blanket cylinder of an offset printing machine that operates on a substrate, the method comprising the following steps:

a) providing a cylindrical body to define the inner cylindrical portion of the blanket sleeve;

b) forming at least one blanket layer including polyurethane material carried by said cylindrical body and defining a printing surface for receiving the inked data to be transferred to the substrate;

c) providing a compressible layer between said blanket layer and said inner cylindrical portion by the steps comprising:

i) depositing on the outer surface of said inner cylindrical portion a first pasty polyurethane material; and ii) causing said first pasty polyurethane material to solidify on the outer surface of said inner cylindrical portion to define the compressible layer of the sleeve; and wherein after said deposition of said first polyurethane material, consolidating said first polyurethane material by cross-linking said first polyurethane material by maintaining said deposited first polyurethane material in an environment heated at one or more temperatures above ambient temperature and below 120° centigrade for a period of time less than five hours.

10. A method for making a blanket sleeve for the blanket cylinder of an offset printing machine that operates on a substrate, the method comprising the following steps:

a) providing a cylindrical body to define the inner cylindrical portion of the blanket sleeve;

b) forming at least one blanket layer including polyurethane material carried by said cylindrical body and defining a printing surface for receiving the inked data to be transferred to the substrate;

c) providing a compressible layer between said blanket layer and said inner cylindrical portion by the steps comprising:

i) depositing on the outer surface of said inner cylindrical portion a first pasty polyurethane material; and ii) causing said first pasty polyurethane material to solidify on the outer surface of said inner cylindrical portion to define the compressible layer of the sleeve; and wherein after said deposition of said first polyurethane material, consolidating said first polyurethane material by cross-linking said first polyurethane material by irradiation for a period of time less than five hours.

11. A method for making a blanket sleeve for the blanket cylinder of an offset printing machine that operates on a substrate, the method comprising the following steps:

a) providing a cylindrical body to define the inner cylindrical portion of the blanket sleeve;

b) forming at least one blanket layer including polyurethane material carried by said cylindrical body and defining a printing surface for receiving the inked data to be transferred to the substrate;

c) providing a compressible layer between said blanket layer and said inner cylindrical portion by the steps comprising:

i) depositing on the outer surface of said inner cylindrical portion a first pasty polyurethane material; and ii) causing said first pasty polyurethane material to solidify on the outer surface of said inner cylindrical portion to define the compressible layer of the sleeve; and wherein said blanket layer is formed by the steps comprising:

a) depositing on said compressible layer a second pasty polyurethane material; and b) causing said second polyurethane material to solidify to define said outer printing layer of the sleeve having a density of between about 1 g/cm$^3$ and about 1.6 g/cm$^3$.

12. A method as in claim 11, wherein after said deposition of said second polyurethane material, cross-linking said second polyurethane material in a heated environment maintained at a temperatures above ambient temperature and less than 120° C.

13. A method as in claim 11, wherein said deposition of said second polyurethane material is implemented automatically.

14. A method for making a compressible layer of a blanket cylinder of an offset printing machine that operates on a substrate, the method comprising the following steps:

a) providing a body that defines a rigid cylindrical surface portion;

b) providing a liquid precursor material wherein one or more polyols compose at least 50% by weight of said liquid precursor material; and c) mixing said liquid precursor material with a second component that includes at least one cross-linking element to form a pasty polyurethane material.

15. A method as in claim 14, further comprising the step of:

d) using ribbon technology to deposit said pasty polyurethane material onto said rigid cylindrical surface portion of said body to adhere said pasty polyurethane material to said rigid cylindrical surface portion of said body.

16. A method as in claim 15, further comprising the step of:

e) allowing said deposited and adhered pasty polyurethane material to solidify at ambient pressure.

17. A method as in claim 16, further comprising the step of:

f) before said mixing step, said liquid precursor material is combined with microspheres.

18. A method as in claim 17, further comprising the step of:

g) grinding said solidified polyurethane material to form a compressible layer to the desired thickness and uniform surface.

19. A method as in claim 14, wherein said polyol is a polyether.

20. A method as in claim 16, further comprising the step of:

f) grinding said solidified polyurethane material to form a printing layer to the desired thickness and uniform surface.

* * * * *